US010253678B2

(12) United States Patent
Kaneko et al.

(10) Patent No.: US 10,253,678 B2
(45) Date of Patent: Apr. 9, 2019

(54) ENGINE COOLING APPARATUS

(71) Applicant: TOYOTA JIDOSHA KABUSHIKI KAISHA, Toyota-shi, Aichi-ken (JP)

(72) Inventors: Rihito Kaneko, Miyoshi (JP); Noboru Takagi, Toyota (JP); Isao Takagi, Okazaki (JP); Takashi Matsutani, Toyota (JP); Naoto Hisaminato, Toyota (JP); Mitsuru Yamaguchi, Nagoya (JP); Hirokazu Ando, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 124 days.

(21) Appl. No.: 15/408,825

(22) Filed: Jan. 18, 2017

(65) Prior Publication Data

US 2017/0218879 A1 Aug. 3, 2017

(30) Foreign Application Priority Data

Feb. 1, 2016 (JP) ..... 2016-017345

(51) Int. Cl.
*F01P 7/16* (2006.01)
*F02B 75/22* (2006.01)
*F01P 7/14* (2006.01)

(52) U.S. Cl.
CPC ..... *F01P 7/16* (2013.01); *F01P 2007/146* (2013.01); *F01P 2037/02* (2013.01); *F02B 75/22* (2013.01)

(58) Field of Classification Search
CPC ..... F01P 7/16; F01P 2007/146; F01P 5/10; F01P 5/12; F01P 11/04; F01P 3/02; F02B 75/22
USPC ..... 123/41.74, 41.01
See application file for complete search history.

(56) References Cited

U.S. PATENT DOCUMENTS

2003/0116105 A1* 6/2003 Pfeffinger ..... F01P 3/20 123/41.31
2009/0020080 A1* 1/2009 Kowada ..... F01P 11/0238 123/41.08
2010/0095909 A1* 4/2010 Lin ..... F01P 11/16 123/41.02

FOREIGN PATENT DOCUMENTS

| | | | |
|---|---|---|---|
| JP | S59-085349 | U | 6/1984 |
| JP | S60-195325 | U | 12/1985 |
| JP | S61-122386 | U | 8/1986 |
| JP | H03-271517 | A | 12/1991 |
| JP | H10-9013 | A | 1/1998 |
| JP | 2003-083063 | A | 3/2003 |
| JP | 2009-041557 | A | 2/2009 |
| JP | 2012-188966 | A | 10/2012 |
| JP | 2013-234605 | A | 11/2013 |

* cited by examiner

*Primary Examiner* — Syed O Hasan
(74) *Attorney, Agent, or Firm* — Oliff PLC

(57) ABSTRACT

An engine cooling apparatus includes a mechanical water pump having a suction hole and N discharge holes (N is an integer not less than two), N water jackets that are arranged in an engine and correspond to the N discharge holes, N joint passages, each of which joins one of the N discharge holes to the associated water jacket, a return passage that returns coolant to the suction hole after the coolant has passed through the N water jackets and has merged in a merging portion, a coolant stopping mechanism that blocks return flow of coolant through the return passage, and N communication passages each of which allows the corresponding one of the N joint passages to communicate with the suction hole while bypassing the N water jackets and the coolant stopping mechanism.

7 Claims, 6 Drawing Sheets

ENGINE COOLING APPARATUS

BACKGROUND OF THE INVENTION

The present disclosure relates to an engine cooling apparatus.

An engine cooling apparatus described in Japanese Laid-Open Patent Publication No. 2013-234605 is known. The engine cooling apparatus of this document includes a coolant circuit in which coolant circulates through a water jacket, a water pump that discharges the coolant into the water jacket, and a coolant stopping mechanism that blocks return flow of coolant to the water pump after the coolant has passed through the water jacket. By blocking the return flow of coolant during engine warm-up, the coolant stopping mechanism performs coolant stopping control to stop coolant circulation in the coolant circuit. This restrains the coolant flowing in the water jacket from taking away heat from the engine, thus promoting the engine warm-up.

By arranging the aforementioned coolant stopping mechanism in a cooling apparatus for a V engine having water jackets each provided in one of the banks to perform the coolant stopping control during engine warm-up, the engine warm-up can be promoted. Some cooling apparatuses for V engines include a mechanical water pump having two discharge holes, each of which independently discharges coolant into the water jacket of one of the two banks. In a cooling apparatus for a V engine employing this water pump, a sufficient warm-up promoting effect may not be obtained through the coolant stopping control.

FIG. 7 shows an example of a coolant circuit of an engine cooling apparatus employed in a V engine having water jackets 50F, 50S, each of which is arranged in one of the banks. The engine cooling apparatus includes a mechanical water pump 52 having two discharge holes 51F, 51S and a coolant stopping mechanism 53, which stops coolant circulation.

As shown in FIG. 7, in the engine cooling apparatus, the two discharge holes 51F, 51S of the water pump 52 are each joined to the corresponding one of the water jackets 50F, 50S through one of joint passage 54F, 54S. A merging portion 55, in which the coolant merges after passing through each of the water jackets 50F, 50S, is arranged downstream of the water jackets 50F, 50S. In the engine cooling apparatus, a coolant circuit is configured such that, after passing through the water jackets 50F, 50S and merging in the merging portion 55, the coolant returns to a suction hole 57 of the water pump 52 through a radiator 56.

A coolant stopping mechanism 53 is arranged at a position between the merging portion 55 and the radiator 56 in the coolant circuit. By blocking coolant flow from the merging portion 55 to the radiator 56 by means of the coolant stopping mechanism 53, coolant stopping control is performed to stop coolant circulation in the coolant circuit.

The mechanical water pump 52, which is driven by rotation of the crankshaft, or the output shaft of the engine, is driven continuously when the coolant circulation in the coolant circuit is stopped. At the time point at which the coolant stopping control is started, a certain amount of coolant remains in the section from the coolant stopping mechanism 53 to the suction hole 57 in the coolant circuit. Therefore, after the coolant stopping mechanism is started, the water pump 52 continues to draw in coolant through the suction hole 57 and discharges the drawn coolant through the discharge holes 51F, 51S for a certain period of time.

In some cases, depending on the layout of auxiliary devices of the engine, the discharge holes 51F, 51S and the joint passages 54F, 54S may have different sizes and/or shapes between the banks. In such cases, the coolant discharge capacity of the water pump 52 may differ between the discharge hole 51F and the discharge hole 518.

In the engine cooling apparatus shown in FIG. 7, the downstream sides of the water jackets 50F, SOS of the two banks are coupled to each other through the merging portion 55. This forms a path that connects the two discharge holes 51F, 51S to each other through the water jackets 50F, 50S during the coolant stopping control. If there is a difference in discharge capacity between the discharge holes 51F and 51S, the coolant discharged from the one of the discharge holes of the greater discharge capacity pushes back the coolant discharged from the other discharge hole of the smaller discharge capacity. This causes circulation of the coolant through the water jackets 50F, 50S. For example, if the discharge capacity from the discharge hole 51F is greater, a coolant circulation occurs such that, as represented by the arrow of the broken line in FIG. 7, the coolant is discharged from the discharge hole 51F, passes through the joint passage 54F, the water jacket 50F, the merging portion 55, the water jacket 50S, and the joint passage 54S, and returns to the discharge hole 518. In contrast, if the discharge capacity from the discharge hole 51S is greater, coolant circulation occurs in the reverse order to the coolant circulation represented by the arrow of the broken line. Once such circulation occurs, the coolant is continuously drawn from the discharge hole corresponding to the smaller discharge capacity even when the coolant cannot be drawn in through the suction hole 57. As a result, such coolant circulation may continue during the coolant stopping control.

Also, even without coolant circulation in the above-described manners, the water pump 52 may draw in coolant from one of the discharge holes 51F, 51S, through which the coolant can be drawn comparatively easily, if the water pump 52 cannot draw in the coolant through the suction hole 57. The water pump 52 then discharges the drawn coolant through the other one of the discharge holes, thus causing coolant circulation in the same manner as the above-described case.

The flow rate of the coolant circulation during the coolant stopping control is low compared to the flow rate of the normal coolant circulation in the coolant circuit. However, this causes the coolant to flow into the water jackets 50F, 50S, even by a small amount, when such coolant flow should not be occurring in the water jackets 50F, 50S. The effect of promoting engine warm-up by the coolant stopping control is thus reduced. Further, even during the coolant stopping control, a slight amount of coolant enters and exits through the suction hole 57. If coolant circulates in the above-described manner and cold coolant enters through the suction hole 57 from the exterior of the engine 10, the cold coolant is mixed with the coolant circulating through the water jackets 50F, 50S. This delays increase of the coolant temperature in each of the water jackets 50F, 50S.

Even slightly different sizes and shapes of the discharge holes 51F, 51S and the joint passages 54F, 54S may cause coolant circulation in the above-described manner. Once a flow of circulating coolant is formed, circulation of the coolant is further promoted. Even an initially slight flow rate of circulating coolant thus may become a measurable flow rate eventually. Therefore, not only when the sizes and the shapes of the discharge holes 51F, 51S and the joint passages 54F, 54S are differentiated intentionally, but also the sizes and shapes are designed to be the same, a slight difference in the sizes and shapes due to machining errors may cause coolant circulation in the above-described manners.

SUMMARY OF THE DISCLOSURE

Accordingly, it is an objective of the present disclosure to restrain decrease of a warm-up promoting effect due to coolant circulation during coolant stopping control, which is supposed to stop the coolant circulation.

To achieve the foregoing objective and in accordance with one aspect of the present disclosure, an engine cooling apparatus is provided that includes a mechanical water pump that is configured to be driven by rotation of an output shaft of an engine and has a suction hole through which coolant is drawn and N discharge holes (N is an integer not less than two) through which the coolant is discharged, N water jackets that are arranged in the engine to extend around a combustion chamber of the engine and each correspond to one of the N discharge holes, N joint passages each of which joins one of the N discharge holes to the associated water jacket, a merging portion in which the coolant merges after passing through the N water jackets, a return passage that returns the coolant that has merged in the merging portion to the suction hole, a coolant stopping mechanism configured to block return flow of the coolant through the return passage, and N communication passages each of which allows one of the N joint passages to communicate with the suction hole while bypassing the N water jackets and the coolant stopping mechanism.

In a circulation path of coolant (a coolant circuit) in the engine cooling apparatus, the N water jackets are arranged in a state connected in parallel. By blocking return flow of coolant from the merging portion to the suction hole by means of the coolant stopping mechanism, coolant stopping control for stopping coolant circulation through the N water jackets is performed. Since the mechanical water pump is employed in the engine cooling apparatus, the water pump continuously operates during the coolant stopping control.

In the engine cooling apparatus, the joint passages communicate with the suction hole through the communication passages during the coolant stopping control. Some of the pressure generated by discharge through the discharge holes escapes toward the suction hole through the communication passages. This correspondingly attenuates the discharge pressure acting on the coolant in the water jackets. As the absolute level of the discharge pressure acting on the coolant in each water jacket decreases, a great difference in discharge pressure among the water jackets becomes unlikely to be generated. This restrains flow of coolant between the water jackets through the merging portion. Also, return flow of coolant through the communication passages causes continuous suction of coolant through the suction hole and continuous discharge of the coolant through the discharge holes during the coolant stopping control. Drawing in of coolant through the discharge holes thus does not happen. As a result, the engine cooling apparatus having the above-described communication passages restrains coolant circulation through the water jackets during the coolant stopping control, thus restraining decrease of the warm-up promoting effect for the engine.

The discharge pressure of the water pump fluctuates and such fluctuation is transmitted to the communication passages through the joint passages. When the N communication passages are merged in a suction-side passage connected to the suction hole, the suction-side passage may have N draw-in holes to each of which one of N communication passages is connected. If any two of the draw-in holes face each other, the fluctuation in the one of the communication passages is transmitted directly to the other the communication passages. As a result, the fluctuations in the two communication passages interfere with each other, thus increasing variation of the internal pressure in the communication passages. This may hamper return flow of coolant through the communication passages. It is thus desirable that each of the N draw-in holes be arranged offset from the other draw-in holes.

If the pressure loss of the coolant returning to the suction hole through the communication passages varies from one communication passage to another, the relationship between the discharge pressure of each discharge hole and the flow rate of the coolant returned through the corresponding communication passage will not be uniform. As a result, the difference in internal pressure among the N communication passages may not be attenuated accurately. Thus, in the engine cooling apparatus, the N communication passages are preferably configured such that pressure losses of the coolant are the same in all of the N communication passages when the coolant returns from the joint passages to the suction hole through the communication passages. If the communication passages are configured by tubes and the tubes have equal lengths and equal inner diameters for all of the N communication passages, the pressure loss is equal for the N communication passages. This facilitates equalizing the pressure loss of the coolant at the time the coolant is returned to the suction hole through the N communication passages.

If return flow of coolant from the joint passages to the suction hole through the communication passages is permitted when the coolant is circulated through the water jackets, the coolant discharged into the joint passages through the discharge holes is distributed to the communication passages and the water jackets. Therefore, if the flow rate of the coolant flowing toward the communication passages is excessively great, a sufficient flow rate in the water jackets cannot be ensured. The pressure loss of the coolant when the coolant returns from the joint passages to the suction hole through the communication passages may be greater than the pressure loss of the coolant when the coolant returns from the joint passages to the suction hole through the water jackets and the return passage. The flow rate of the coolant flowing from the joint passages to the corresponding water jackets is thus greater than the flow rate of the coolant flowing toward the communication passages. This readily ensures a sufficient flow rate of coolant in the water jackets.

If the water pump, the N joint passages, and the passage connected to the suction hole are arranged in the chain cover, hoses that joins the N joint passages to the in-cover passage may configure the N communication passages. If the communication passages are arranged in the limited space in the chain cover and the communication passages are configured by hard components each having a fixed shape, such as pipes, arrangement of the communication passages may be difficult. However, if freely bendable soft hoses are used, arranging the communication passages is relatively easy.

In a cooling apparatus for a V engine having water jackets each arranged in one of the two banks, coolant stopping control can be accomplished using a simple configuration by arranging a coolant stopping mechanism in a section downstream of the merging portion in which coolant merges after passing through the water jackets of the banks, compared to arranging a coolant stopping mechanism at a position downstream of the water jacket of each bank. However, if a mechanical water pump having two discharge holes through which coolant is discharged into the water jackets of the banks, a path in which the coolant circulates through the water jackets is formed in a section upstream of the coolant stopping mechanism in the coolant circuit. In this case, the possibility of the coolant circulation during the coolant stopping control, which decreases the warm-up promoting effect, cannot be ruled out. The coolant circulation during the coolant stopping control can be prevented by either forming a single discharge hole in the water pump such that the coolant is divided into the branches corresponding to the two water jackets through the joint passages or arranging coolant a stopping mechanism at a position downstream of each water jacket. However, for such prevention, the configuration must be modified to a great extent. In this regard, the above-described engine cooling apparatus restrains the coolant circulation during the coolant stopping control simply through comparatively minor modification to the configuration, which is arranging two communication passages joining the joint passages to the suction hole. This restrains increase of the manufacturing cost, which would otherwise be caused by modification of the configuration.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which:

DETAILED DESCRIPTION OF THE PREFERRED EMBODIMENTS

First Embodiment

Figure 1:
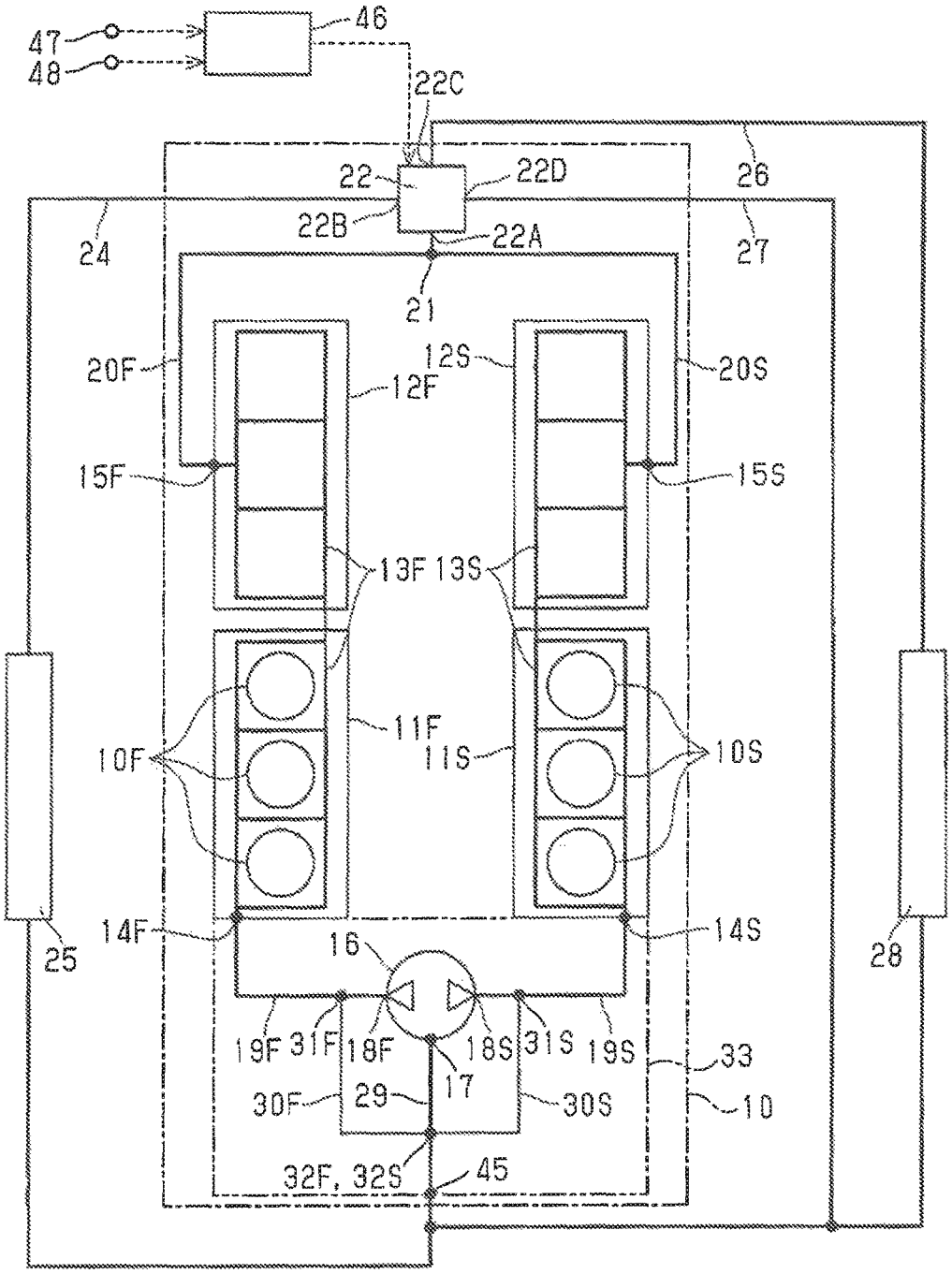
FIG. 1 is a diagram schematically illustrating the configuration of a coolant circuit included in an engine cooling apparatus according to a first embodiment.

An engine cooling apparatus according to a first embodiment will now be described in detail with reference to FIGS. 1 to 5C. The engine cooling apparatus of the present embodiment is employed in a V engine having two cylinder rows (two banks). Hereinafter, the power output side of the engine, which is the side to which a transmission is connected, will be referred to as the rear of the engine, with the section at the side opposite to the rear section referred to as the front. Also, the bank located on the left side as viewed from the front of the engine will be referred to a first bank, with the bank located on the right side referred to as a second bank. The components of the engine cooling apparatus of the present embodiment include components forming pairs, with one of each pair arranged in one of the two banks and the other in the other bank. The components of these pairs are each given a reference numeral starting with a common number for the corresponding one of the pairs and ending with "F" if the component corresponds to the first bank and "S" if the component corresponds to the second bank.

As shown in FIG. 1, an engine 10, which includes the aforementioned two banks, has two water jackets 13F, 13S, each of which is provided in one of the banks. That is, the water jacket 13F is a passage in the engine 10 through which coolant flows around combustion chambers 10F of cylinders of the first bank. The water jacket 13S is a passage in the engine 10 through which coolant flows around combustion chambers 10S of cylinders of the second bank. The water jacket 13F is configured to extend through the interior of a cylinder block 11F and the interior of a cylinder head 12F of the first bank. The water jacket 13S is configured to extend through the interior of a cylinder block 11S and the interior of a cylinder head 12S of the second bank. Each of the water jackets 13F, 13S has an inflow hole 14F, 14S for coolant, which is arranged in the corresponding one of the cylinder blocks 11F, 11S, and an outflow hole 15F, 15S for coolant, which is arranged in the corresponding one of the cylinder heads 12F, 12S.

The engine cooling apparatus of the present embodiment includes a coolant circuit in which the coolant circulates through the water jackets 13F, 138. In the coolant circuit, the two water jackets 13F, 13S are connected in parallel. That is, the coolant flow in the coolant circuit is branched into two flows at a position upstream of the water jackets 13F, 13S. The branch flows then proceed through the respective water jackets 13F, 13S before merging.

The coolant circuit includes a mechanical water pump 16, which is driven by rotation of a crankshaft 42 (see FIG. 2), which is the output shaft of the engine 10. In the present embodiment, a centrifugal pump is employed as the water pump 16. The water pump 16 has a suction hole 17 and two discharge holes 18F, 18S. When driven, the water pump 16 discharges, through the two discharge holes 18F, 18S, the coolant that has been drawn in through the suction hole 17.

The one of the discharge holes 18F, 18S corresponding to the first bank, which is the discharge hole 18F, is joined to the inflow hole 14F of the water jacket 13F of the first bank through a joint passage 19F. The one of the discharge holes 18F, 18S corresponding to the second bank, which is the discharge hole 18S, is joined to the inflow hole 14S of the water jacket 13S of the second bank through a joint passage 19S. In the present engine cooling apparatus, the water pump 16 and the two joint passages 19F, 19S are arranged in a chain cover 33, which is arranged to cover sections of the cylinder blocks 11F, 11S and the cylinder heads 12F, 12S located on the engine front side.

Outflow passages 20F, 20S are joined to the outflow holes 15F, 15S of the water jackets 13F, 13S. The two outflow passages 20F, 20S are merged in a merging portion 21 before being connected to a flow control valve 22.

The flow control valve 22 includes an inflow port 22A, into which coolant flows through the outflow passages 20F, 20S, and three outflow ports 22B, 22C, 22D, through which the coolant that has flowed into the flow control valve 22 through the inflow port 22A can be discharged. A radiator passage 24, which has a radiator 25 that cools the coolant through heat exchange with the external air, is connected to the outflow port 22B. A heater passage 26, which has a heater core 28 that heats the air to be supplied to the passenger compartment through heat exchange with the coolant, is connected to the outflow port 22C. A bypass passage 27, in which the coolant flows bypassing both the radiator 25 and the heater core 28, is connected to the outflow port 22D. The flow control valve 22 is configured to regulate the flow rate of the coolant flowing into each of the passages, which are the radiator passage 24, the heater passage 26, and the bypass passage 27, by varying the cross-sectional area of the corresponding outflow port 22B, 22C, 22D.

The downstream end of the radiator passage 24 is connected to an in-cover passage 29, which is arranged in the chain cover 33, through a connector 45 arranged in the chain cover 33. The downstream end of the in-cover passage 29 is connected to the suction hole 17 of the water pump 16. The downstream end of the heater passage 26 is connected to a section of the radiator passage 24 downstream of the radiator 25. The downstream end of the bypass passage 27 is connected to a section of the heater passage 26 downstream of the heater core 28. The radiator passage 24, the heater passage 26, and the bypass passage 27 are a return passage that returns the coolant that has merged in the merging portion 21 to the suction hole 17 of the water pump 16.

The coolant circuit also has two communication passages 30F, 30S, which join the corresponding joint passages 19F, 19S to the in-cover passage 29. The communication passages 30F, 30S ensure communication between the corresponding joint passages 19F, 19S and the suction hole 17 of the water pump 16.

The operation of the flow control valve 22, which is arranged in the coolant circuit, is controlled by an electronic control unit 46 for controlling the engine. The electronic control unit 46 controls the operation of the flow control valve 22 in accordance with detection results of an inlet coolant temperature sensor 47 and an outlet coolant temperature sensor 48 and the status of use of the heater in the passenger compartment, thus regulating the flow rate of the coolant flowing in each of the passages, which are the radiator passage 24, the heater passage 26, and the bypass passage 27. The inlet coolant temperature sensor 47 is a sensor that detects the temperature of the coolant flowing into either the inflow hole 14F or the inflow hole 14S (the inlet coolant temperature). The outlet coolant temperature sensor 48 is a sensor that detects the temperature of the coolant flowing out from either the outflow hole 15F or the outflow hole 15S (the outlet coolant temperature).

In controlling the operation of the flow control valve 22, the electronic control unit 46 performs coolant stopping control if the outlet coolant temperature is lower than or equal to a predetermined coolant stopping temperature during warm-up of the engine 10. During the coolant stopping control, the flow control valve 22 is operated to close all of the three outflow ports 22B, 22C, 22D. This brings about a state in which coolant does not flow into any of the radiator passage 24, the heater passage 26, and the bypass passage 27. This blocks return flow of coolant from the merging portion 21 to the suction hole 17 of the water pump 16, thus stopping circulation of the coolant in the coolant circuit. In the engine cooling apparatus of the present embodiment, the flow control valve 22, which blocks the return flow of coolant from the merging portion 21 to the suction hole 17 during the coolant stopping control, corresponds to a coolant stopping mechanism.

Figure 2:
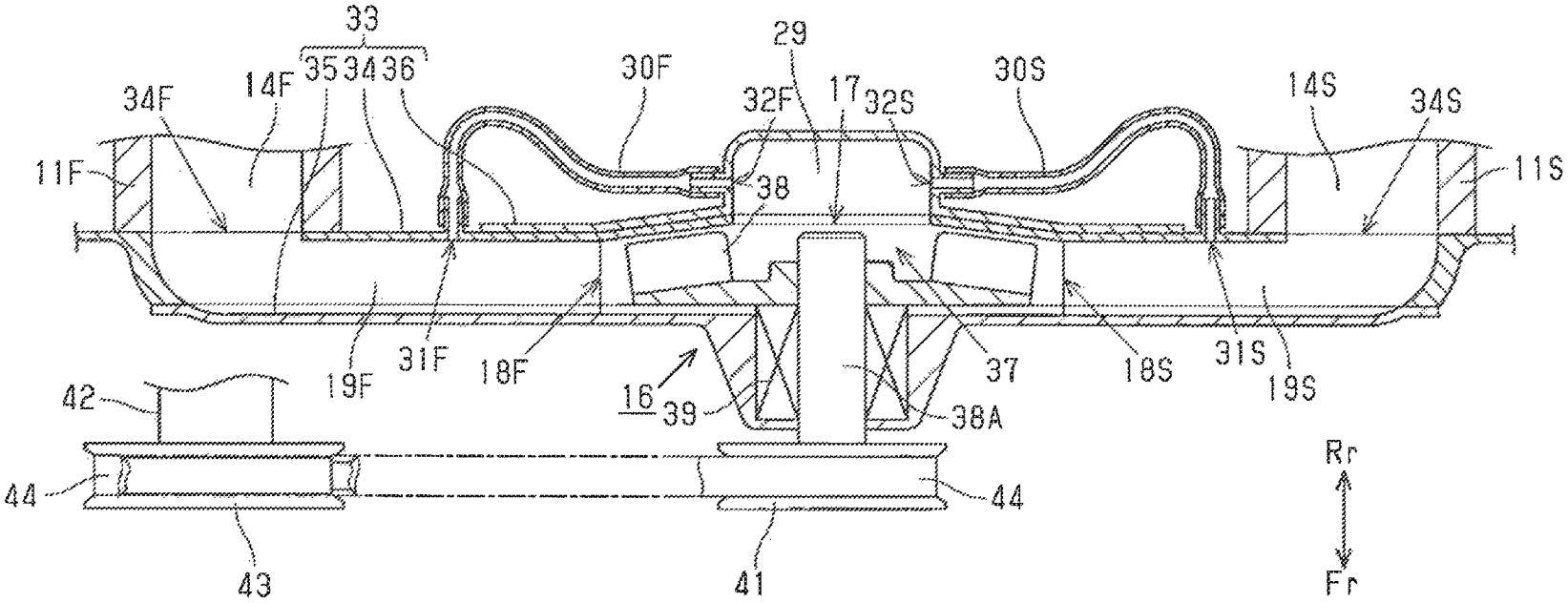
FIG. 2 is a cross-sectional view schematically showing the internal structures of a water pump and its peripheral components, which are components of the engine cooling apparatus of FIG. 1.

Next, the configuration of the water pump 16 and its peripheral components in the coolant circuit will be described in further detail, with reference to FIGS. 2 and 3. In FIG. 2, the front and the rear of the engine 10 are represented by Fr and Rr, respectively. Also, in the drawing in, the internal structure of each of the sections is schematically shown for illustrative purposes. Therefore, the cross-sectional structure shown in FIG. 2 does not necessarily have to match the structure shown in the plan view of the water pump 16 in FIG. 3.

Referring to FIG. 2, the chain cover 33 has three stacked plates, which are a main plate 34, a pump cover 35, and an inner plate 36. The pump cover 35 is arranged to be stacked on the surface of the main plate 34 located on the engine front side. The inner plate 36 is arranged to be stacked on the surface of the main plate 34 located on the engine rear side.

A cylindrical space, which forms a pump chamber 37 for the water pump 16, is defined between the main plate 34 and the pump cover 35. The pump chamber 37 accommodates an impeller 38 of the water pump 16. A rotary shaft 38A of the impeller 38 is rotationally supported by a bearing 39, which is fixed to the pump cover 35. A pump pulley 41 is attached to the end section of the rotary shaft 38A of the impeller 38 located on the engine front side in an integrally rotational manner. A belt 44 is looped over the pump pulley 41 and a crank pulley 43, which is attached to an end section of the crankshaft 42 in an integrally rotational manner. The rotation of the crankshaft 42 is thus transmitted to the pump pulley 41 and then to the impeller 38 through the rotary shaft 38A.

The belt 44 is also looped over an auxiliary-device pulley, which is fixed to a rotary shaft of any one of engine auxiliary devices other than the water pump. For a reason related to the layout of the pulleys, the pump pulley 41 is arranged at a position closer to the second bank than the middle line between the two banks. Therefore, the pump chamber 37 is also located at a position closer to the second bank than the middle line between the banks.

The two discharge holes 18F, 18S are formed in the outer periphery of the pump chamber 37 at opposite positions on the outer periphery. The discharge holes 18F, 18S are connected to the joint passages 19F, 19S, which are formed between the main plate 34 and the pump cover 35, like the pump chamber 37. The joint passage 19F extends from the discharge hole 18F toward the first bank and is joined to the inflow hole 14F of the water jacket 13F, which is arranged in the cylinder block 11F of the first bank, through a through-hole 34F formed in the main plate 34. The joint passage 19S extends from the discharge hole 18S toward the second bank and is joined to the inflow hole 14S of the water jacket 13S, which is arranged in the cylinder block 11S of the second bank, through a through-hole 34S formed in the main plate 34.

As has been described, the pump chamber 37 is located at a position closer to the second bank than the middle line between the two banks. In the engine 10, the inflow holes 14F, 14S of the water jackets 13F, 13S of the two banks are arranged at symmetrical positions. The length of the joint passage 19S corresponding to the second bank is thus less than the length of the joint passage 19F corresponding to the first bank. The different lengths of the joint passages 19F, 19S may cause a difference between the pressure loss of the coolant passing through the joint passage 19F and the pressure loss of the coolant passing through the joint passage 198, thus causing a difference between the flow rate of the coolant in the water jacket 13F and the flow rate of the coolant in the water jacket 13S. In the engine cooling apparatus, the cross-sectional area of the discharge hole 18F corresponding to the first bank 1 is greater than the cross-sectional area of the discharge hole 18S corresponding to the second bank. Also, the cross-sectional area of the joint passage 19F corresponding to the first bank is greater than the cross-sectional area of the joint passage 19S corresponding to the second bank. This configuration equalizes the pressure loss of the coolant flowing through the joint passage 19F and the pressure loss of the coolant flowing through the joint passage 19S. The pressure loss of the coolant flowing through the joint passage 19F and the pressure loss of the coolant flowing through the joint passage 19S can also be equalized by either equalizing the cross-sectional areas of the joint passages 19F, 19S while varying the cross-sectional areas of the discharge holes 18F, 18S or equalizing the cross-sectional areas of the discharge holes 18F, 18S while varying the cross-sectional areas of the joint passages 19F, 19S.

The aforementioned in-cover passage 29 is formed between the main plate 34 and the inner plate 36. A circular hole, which forms the suction hole 17, is formed in a section of the main plate 34 that is opposed to the rotary shaft 38A of the impeller 38. The in-cover passage 29 communicates with the pump chamber 37 through the circular hole. As shown in FIG. 3, the in-cover passage 29, serving as a suction-side passage, is configured to connect a connector 45, to which the radiator passage 24 is connected, to the suction hole 17. In the present engine cooling apparatus, the connector 45 is arranged in the pump cover 35.

Draw-out holes 31F and 31S are formed in the joint passages 19F and 19S, respectively. The communication passages 30F and 30S are connected to the draw-out holes 31F and 31S, respectively. The end of each of the communication passages 30F, 30S on the side opposite to the end connected to the corresponding one of the draw-out holes 31F, 31S is connected to a corresponding one of draw-in holes 32F, 32S, which are formed in the in-cover passage 29. In FIG. 2, the draw-in holes 32F, 32S in the in-cover passage 29 are located in the immediate proximity of the suction hole 17 for illustrative purposes. However, in reality, the draw-in holes 32F, 32S are arranged at positions spaced from the suction hole 17 as illustrated in FIG. 3.

Tubes having equal inner diameters and equal lengths are used for the communication passages 30F, 30S. The inner diameter of the tube configuring each of the communication passages 30F, 30S is set such that the pressure loss of the coolant returning from each the joint passages 19F, 19S to the suction hole 17 through the communication passages 30F, 30S is greater than the pressure loss of the coolant circulating through the water jackets 13F, 13S in the coolant circuit.

The present engine cooling apparatus employs hoses formed of elastic material, such as rubber, as the tubes configuring the communication passages 30F, 30S for the reason described below.

Figure 3:
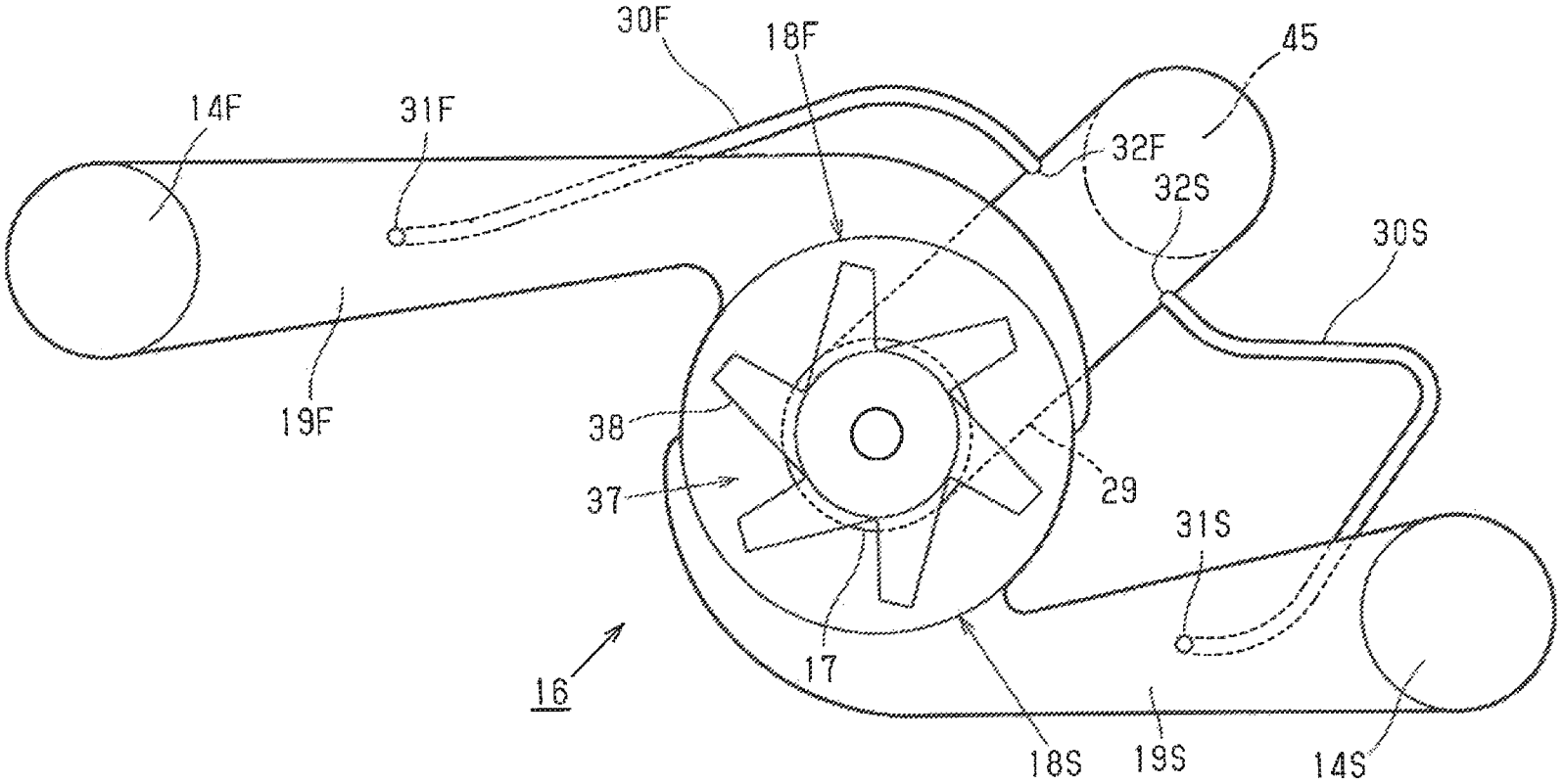
FIG. 3 is a plan view showing the water pump of FIG. 2 and its peripheral components as viewed from the front of the engine.

With reference to FIG. 3, in the present engine cooling apparatus, the distance between the draw-out hole 31F and the draw-in hole 32F of the communication passage 30F corresponding to the first bank is different from the distance between the draw-out hole 31S and the draw-in hole 32S of the communication passage 30S corresponding to the second bank. Therefore, to equalize the lengths of the tubes forming the two communication passages 30F, 30S, the tubes must be shaped differently from each other. In this regard, by employing soft, freely bendable hoses as such tubes, the communication passages 30F, 30S can be configured by the same components, thus decreasing the number of the components. Also, the communication passages 30F, 30S must be arranged in the limited space in the chain cover 33. If the communication passages 30F, 30S are configured using hard components having a fixed shape, such as pipes, arrangement of the communication passages 30F, 30S may be difficult. However, the use of freely bendable hoses facilitates arrangement of the communication passages 30F, 30S.

During the coolant stopping control, the coolant in the pump chamber 37 is stirred through rotation of the impeller 38 in the water pump 16. The influence by such stirring may form turbulence in sections of the joint passages 19F, 19S in the proximities of the discharge holes 18F, 18S or a portion of the in-cover passage 29 in the proximity of the suction hole 17. If the draw-out holes 31F, 31S or the draw-in holes 32F, 32S of the communication passages 30F, 30S are arranged in one of these sections, the influence by such turbulence may hamper return flow of coolant through the communication passages 30F, 30S, thus making it unlikely that coolant circulation will be restrained sufficiently. It is thus desirable that the draw-out holes 31F, 31S and the draw-in holes 32F, 32S of the communication passages 30F, 30S be arranged at such positions spaced from the discharge holes 18F, 18S and the suction hole 17 that the draw-out holes 31F, 31S and the draw-in holes 32F, 32S are not influenced by the turbulence.

Operational Advantages

Operation and effects of the engine cooling apparatus according to the present embodiment, which is configured as described above, will hereafter be described.

When the engine 10 is in operation, the water pump 16 is driven by rotation of the crankshaft 42 to discharge the coolant that has been drawn in through the suction hole 17 through the two discharge holes 18F, 18S. The coolant, after being discharged through the discharge holes 18F, 18S, is supplied to the water jackets 13F, 13S of the two banks through the joint passages 19F, 19S. After passing through each of the water jacket 13F, 13S, the coolant passes through the outflow passages 20F, 20S and merges in the merging portion 21 before flowing into the flow control valve 22.

At this time, if at least one of the three outflow ports 22B, 22C, 22D of the flow control valve 22 is open, the coolant, after passing through the flow control valve 22, is returned to the suction hole 17 of the water pump 16 through one or more corresponding ones of the radiator passage 24, the heater passage 26, and the bypass passage 27 and the in-cover passage 29. As a result, the coolant circulates in the coolant circuit through the water jackets 13F, 13S.

While circulating through the water jackets 13F, 13S, coolant is continuously returned from the joint passages 19F, 19S to the suction hole 17 through the communication passages 30F, 30S. The flow rate of the coolant flowing in the water jackets 13F, 13S becomes lower than the flow rate of the coolant discharged by the water pump 16 through the discharge holes 18F, 18S by the amount corresponding to the flow rate of the coolant that returns in the above-described manner. Therefore, if the flow rate in each communication passage 30F, 30S becomes excessively great, a sufficient flow rate of coolant in the water jackets 13F, 13S cannot be ensured.

However, in the engine cooling apparatus of the present embodiment, as has been described, the pressure loss of the coolant returning from each joint passage 19F, 19S to the suction hole 17 through the corresponding communication passage 30F, 30S is sufficiently greater than the pressure loss of the coolant that, after flowing from each joint passage 19F, 19S and passing through the corresponding water jacket 13F, 13S, circulates to the suction hole 17 through any of the radiator passage 24, the heater passage 26, and the bypass passage 27, which are the return passages. The flow rate in each communication passage 30F, 30S is thus slight compared to the flow rate in the corresponding water jacket 13F, 13S. This restricts decrease of the flow rate in each water jacket 13F, 13S due to the return flow of coolant through the corresponding communication passage 30F, 30S. As a result, the engine cooling apparatus of the present embodiment ensures a sufficient flow rate of coolant in each water jacket 13F, 13S without employing any means that increase the manufacturing costs, including employing a large-sized water pump having great discharge capacity and arranging valves that close the communication passages 30F, 30S at times other than during the coolant stopping control.

When the above-described coolant stopping control is started by the electronic control unit 46, all of the outflow ports 22B, 22C, 22D of the flow control valve 22 are closed. This blocks return flow of coolant from the merging portion 21 to the suction hole 17 of the water pump 16. As a result, the coolant discharged from the discharge holes 18F, 18S of the water pump 16 is retained in the section of the coolant circuit upstream of the flow control valve 22 (a coolant stopping section).

During the coolant stopping control, the water pump 16, which is a mechanical pump, is continuously driven by rotation of the crankshaft 42. In a period immediately after the start of the coolant stopping control, a certain amount of coolant remains in the radiator passage 24, the heater passage 26, the bypass passage 27, and the in-cover passage 29. Therefore, even after the start of the coolant stopping control, the water pump 16 draws in coolant through the suction hole 17 and discharges the coolant through the two discharge holes 18F, 18S for a certain period of time.

In the coolant circuit of the engine cooling apparatus of the present embodiment, a path allowing coolant to flow through the water jackets 13F, 13S is formed between the two discharge holes 18S, 18F in the coolant stopping section during the coolant stopping control. That is, the path is either a path extending from the discharge hole 18F of the water pump 16 to pass through the joint passage 19F, the water jacket 13F, and the outflow passage 20F corresponding to the first bank, and then through the merging portion 21 to the outflow passage 20S, the water jacket 13S, and the joint passage 19S corresponding to the second bank before returning to the water pump 16 through the discharge hole 18S or a path in the reverse direction.

If coolant circulates along either one of the aforementioned paths during the coolant stopping control, the coolant flows into the water jackets 13F, 13S, in which flow of coolant is supposed to be stopped. This decreases the warm-up promoting effect of the coolant stopping control for the engine 10. Such coolant circulation is caused by the difference in the discharge capacity between the discharge hole 18F and the discharge hole 18S of the water pump 16. In the engine cooling apparatus of the present embodiment, the sizes and shapes of the discharge holes 18F, 18S and the joint passages 19F, 19S are different between the first bank and the second bank. The difference in the discharge capacity is thus likely to occur.

Also, when coolant cannot be drawn in through the suction hole 17, the water pump 16 draws in the coolant through either one of the discharge holes 18F, 18S, instead of the suction hole 17, this causes the above-described coolant circulation during the coolant stopping control. Such drawing in of the coolant through the discharge hole 18F, 18S is caused by symmetry breaking of the hydrodynamic state between the side corresponding to the discharge hole 18F and the side corresponding to the discharge hole 183. Any difference in the sizes and shapes between the discharge holes 18F and 18S and between the joint passages 19F and 193 can be a major factor causing such symmetry breaking.

However, in the engine cooling apparatus of the present embodiment, the joint passages 19F, 19S communicate with the suction hole 17 of the water pump 16 through the communication passages 30F, 303 even during the coolant stopping control. This allows some of the pressure generated by the coolant discharged through the discharge holes 18F, 18S to escape toward the suction hole 17 through the communication passages 30F, 30S. The discharge pressure acting on the coolant in each of the water jackets 13F, 13S is thus attenuated correspondingly. As the absolute level of the discharge pressure acting on the coolant in each water jacket 13F, 13S decreases, the difference in discharge pressure decreases. This restrains the flow of coolant in the water jackets 13F, 13S through the merging portion 21.

When there is a difference in pressure loss between the coolant returning to the suction hole 17 through the communication passage 30F and the coolant returning to the suction hole 17 through the communication passage 30S, there is a difference in the effect of attenuating the discharge pressure between the communication passage 30F and the communication passage 30S. In some cases, the difference between the discharge pressure acting on the coolant in the water jacket 13F and the discharge pressure acting on the coolant in the water jacket 13S may even be increased. In such cases, coolant circulation caused by the difference in discharge capacity cannot be restrained appropriately.

The joint passages 19F, 19S, the communication passages 30F, 30S, and the in-cover passage 29 configure the return flow path of coolant from the discharge holes 18F, 18S to the suction hole 17 through the communication passages 30F, 30S. Each of the communication passages 30F, 30S has a small cross-sectional area compared to the joint passages 19F, 19S and the in-cover passage 29. The proportion of the pressure loss in the communication passages 30F, 30S with respect to the total pressure loss in the return flow path is thus great. In the engine cooling apparatus of the present embodiment, the tubes having equal inner diameters and equal lengths are used as the tubes configuring the communication passages 30F, 30S. The pressure loss in the communication passage 30F and the pressure loss in the communication passage 30S are thus equal. This restricts difference in the pressure loss in the return flow path to a small value, thus further reliably restraining the coolant circulation caused by the difference in discharge capacity between the discharge holes 18F and 18S.

It is desirable to equalize the pressure loss in the section from the discharge hole 18F to the draw-out holes 31F of the communication passage 30F in the joint passage 19F and the pressure loss in the section from the discharge hole 18S to the draw-out holes 31S of the communication passage 30S in the joint passage 19S. In the engine cooling apparatus of the present embodiment, the cross-sectional area of the discharge hole 18F and the cross-sectional area of the joint passage 19F corresponding to the first bank are greater than those corresponding to the second bank. Therefore, by increasing the distance from the discharge hole 18F to the draw-out hole 31F in the joint passage 19F corresponding to the first bank compared to the distance from the discharge hole 18S to the draw-out hole 31S in the joint passage 19S corresponding to the second bank, the pressure losses in the aforementioned sections can be equalized. If the discharge holes 18F, 18S have equal cross-sectional areas and the joint passages 19F, 19S have equal cross-sectional areas, the pressure losses in the sections can be equalized by equalizing the distance from the discharge hole 18F to the draw-out hole 31F in the joint passage 19F and the distance from the discharge hole 18S to the draw-out hole 31S in the joint passage. However, as has been described, the proportion of the pressure loss in the sections of the joint passages 19F, 19S is not substantially great with respect to the total pressure loss in the return flow path. As a result, no problem is caused in the actual use as long as there is not a significant difference between the distance from the discharge hole 18F to the draw-out hole 31F in the joint passage 19F and the distance from the discharge hole 18S to the draw-out hole 31S in the joint passage 19S.

Figure 4:
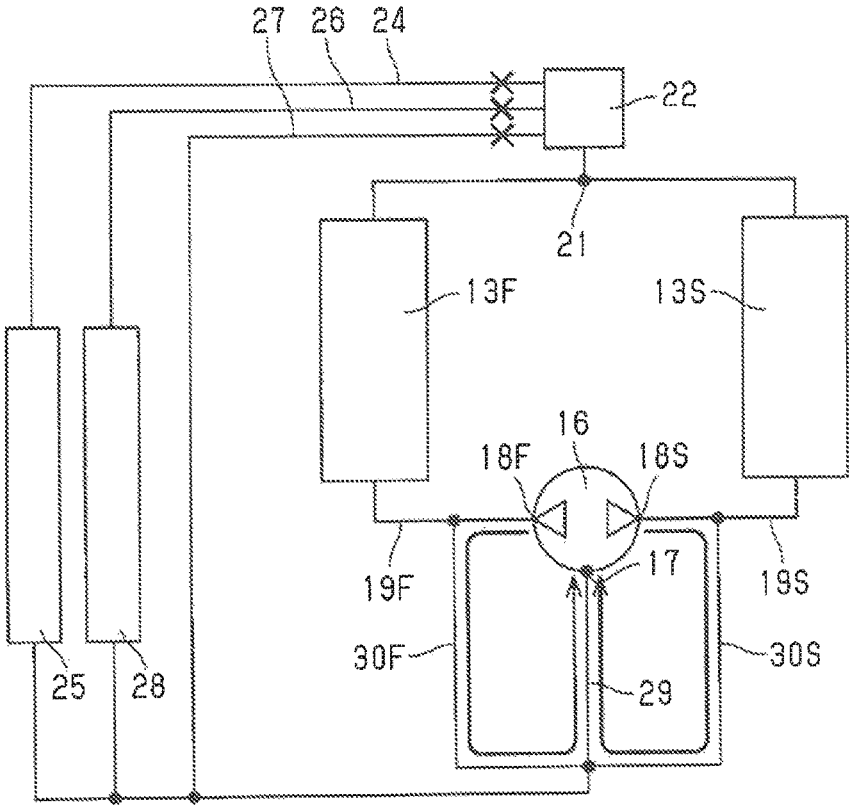
FIG. 4 is a diagram representing a coolant flow in the engine cooling apparatus of FIG. 1 during coolant stopping control.

Since the coolant flows through the communication passages 30F, 30S, two coolant circulations are formed during the coolant stopping control, as illustrated in FIG. 4. That is, one of the circulations starts from the pump chamber 37 (see FIGS. 2 and 3) of the water pump 16, passes through the discharge hole 18F, the joint passage 19F, the communication passage 30F, and the in-cover passage 29 in the order, and returns to the pump chamber 37 through the suction hole 17. The other one of the circulations starts from the pump chamber 37 of the water pump 16, passes through the discharge hole 18S, the joint passage 19S, the communication passage 30S, and the in-cover passage 29 in the order, and returns to the pump chamber 37 through the suction hole 17.

Such coolant circulations ensure continuous suction of coolant through the suction hole 17 and continuous discharge of the coolant through the discharge holes 18F, 18S during the coolant stopping control. The coolant is thus continuously drawn in through the suction hole 17. This restrains drawing in of the coolant from the discharge holes 18F, 18S instead of the suction hole 17 and the coolant circulation caused by such drawing in during the coolant stopping control.

As has been described, the engine cooling apparatus of the present embodiment restrains the decrease of the warm-up promoting effect due to the coolant circulation during the coolant stopping control, which is supposed to stop the coolant circulation.

The coolant circulation through the water jackets 13F, 13S during the coolant stopping control can be prevented from occurring by modifying the configuration of the coolant circuit. For example, the water pump may have a single discharge hole and the coolant may be divided into branches corresponding to the water jackets of the two banks in the joint passage. This configuration prevents the coolant circulation from occurring during the coolant stopping control. However, many of the cooling apparatuses for V engines employ a water pump having two discharge holes to decrease the length of each communication passage. Therefore, to provide the above-described configuration, the configuration must be modified to a great extent. In this regard, in the present embodiment, the coolant circulation in the coolant stopping section during the coolant stopping control is restrained only through a comparatively simple modification of the configuration, which is arranging the two communication passages 30F, 30S, which join the corresponding joint passages 19F, 19S to the suction hole 17. This restrains increase of costs, which is otherwise caused by modifying the configuration.

In the engine cooling apparatus of the above-described embodiment, the communication passages 30F, 30S are connected to the in-cover passage 29, which is connected to the suction hole 17. The coolant returned through the communication passage 30F and the coolant returned though the communication passage 30S are thus merged in the in-cover passage 29. In the coolant merging portion of the communication passages 30F, 30S, the problem described below may occur.

Figure 5A:
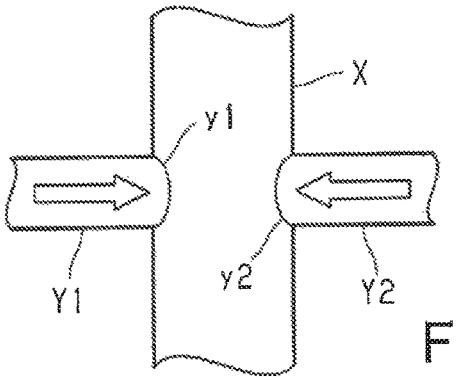
FIGS. 5A, 5B, and 5C are schematic views each showing an example of the connection mode of communication passages with respect to a suction-side passage.
Figure 5B:
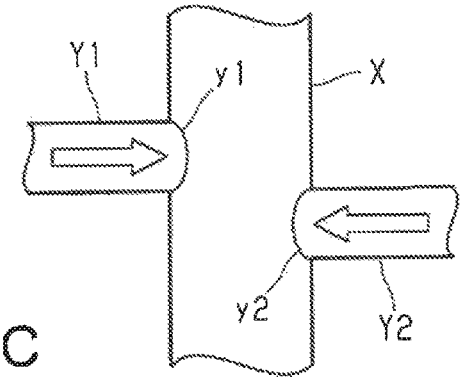
Figure 5C:
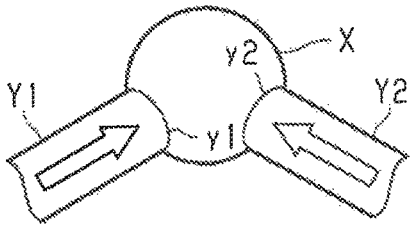

That is, the discharge pressure of the water pump fluctuates and such fluctuation is transmitted to the communication passages. As illustrated in FIG. 5A, draw-in holes y1, y2 of two communication passages Y1, Y2 may be arranged at mutually facing positions with respect to a suction-side passage X, which is connected to a suction hole. In this case, fluctuation in one of the communication passages Y1 (Y2) is directly transmitted to the other one of the communication passages Y2 (Y1). The fluctuations then interfere with each other in the two communication passages Y1, Y2, thus increasing variation of the internal pressures. This hampers return flow of coolant through the communication passages Y1, Y2. Therefore, when the draw-in holes y1, y2 are arranged to face each other, the effect of restraining the coolant circulation during the coolant stopping control may decrease.

Such interference of the fluctuations can be restrained if the draw-in holes y1, y2 of the communication passages Y1, Y2 are arranged without facing each other. For example, in the configuration illustrated in FIG. 5B, the communication passages Y1, Y2 are connected to the suction-side passage X at offset positions in the extending direction of the suction-side passage X such that the draw-in holes y1, y2 do not face each other. Alternatively, in the configuration illustrated in FIG. 5C, the communication passage Y2 is connected to the suction-side passage X in a direction other than the opposite direction to the connecting direction of the communication passage Y1, which is the other communication passage, with respect to the suction-side passage X, such that the draw-in holes y1, y2 do not face each other. If three or more communication passages merge in a suction-side passage connected to a draw-in hole, the communication passages may be arranged such that any one of the draw-in holes of the communication passages does not face another one of the draw-in holes. This restrains interference of fluctuations between any ones of the communication passages.

If the suction-side passage X in which the communication passages Y1, Y2 merge has a sufficiently great volume, the distance between the draw-in holes y1, y2 is sufficiently great even when the draw-in holes y1, y2 face each other. Transmission of fluctuation from one to the other of the communication passages is thus limited. This allows connection of the communication passages Y1, Y2 to the suction-side passage X with the draw-in holes y1, y2 facing each other. The in-cover passage 29 of the engine cooling apparatus of the above-described embodiment has a sufficiently great volume to such an extent that transmission of fluctuation between the communication passages 30F, 30S does not cause any problem. Therefore, in the above-described embodiment, the draw-in holes 32F, 32S of the two communication passages 30F, 30S are arranged to face each other without causing any problem.

The above described embodiment may be modified as follows.

In the above-described embodiment, hoses are employed as the tubes configuring the communication passages 30F, 30S. However, comparatively hard pipes formed of metal or plastic may be employed as the tubes configuring the communication passages 30F, 30S.

In the above-described embodiment, the water pump 16 and the joint passages 19F, 19S are arranged in the chain cover 33. However, the water pump 16 and the joint passages 19F, 19S may be arranged at any location other than in the chain cover 33. For example, the water pump 16 and the joint passages 19F, 19S may be arranged in the corresponding cylinder blocks 11F, 11S.

In the above-described embodiment, by blocking outflow of coolant into the radiator passage 24, the heater passage 26, and the bypass passage 27 simultaneously, the flow control valve 22 blocks return flow of coolant from the merging portion 21 to the suction hole 17. However, such return flow may be blocked by any other mechanism. For example, independent valves may be arranged separately in the radiator passage 24, the heater passage 26, and the bypass passage 27. By closing the valves simultaneously, the return flow of coolant from the merging portion 21 to the suction hole 17 is blocked. In this case, the three valves configure a coolant stopping mechanism.

In the above-described embodiment, the three passages, which are the radiator passage 24, the heater passage 26, and the bypass passage 27, are arranged in parallel as the passages for returning coolant from the merging portion 21 to the suction hole 17 in the coolant circuit. However, the number of these passages may be either less or more than three.

In the above-described embodiment, the tubes configuring the communication passages 30F, 30S are sized such that the pressure loss of the coolant returning from the joint passages 19F, 19S to the suction hole 17 through the communication passages 30F, 30S is sufficiently greater than the pressure loss of the coolant circulating in the coolant circuit through the water jackets 13F, 13S. Such greater pressure loss naturally restricts the flow rate of the coolant returning through the communication passages 30F, 30S. To ensure that a great amount of coolant returns through the communication passages 30F, 30S to restrain the coolant circulation during the coolant stopping control, the following may be performed. That is, the pressure loss of the coolant returning through the communication passages 30F, 30S is either equalized to or increased compared to the pressure loss of the coolant circulating in the coolant circuit. Also, valves for either blocking or restricting the return flow are arranged in the communication passages 30F, 30S. In this manner, a great amount of coolant returns through the communication passages 30F, 30S during the coolant stopping control, thus restraining coolant circulation. On the other hand, at times other than during the coolant stopping control, the flow rate of the coolant returned through the communication passages 30F, 30S is decreased to ensure a sufficiently great flow rate of coolant in the water jackets 13F, 138.

In the above-described embodiment, the tubes (the hoses) configuring the communication passages 30F, 30S have equal lengths and equal inner diameters, thus equalizing the pressure loss of the coolant returning from the joint passage 19F to the suction hole 17 through the communication passage 30F and the pressure loss of the coolant returning from the joint passage 19S to the suction hole 17 through the communication passage 30S. Even if the tubes have unequal inner diameters and unequal lengths, the difference in internal pressure between the joint passages 19F and 19S, which is caused by the difference in discharge capacity between the discharge holes 18F and 18S, is decreased further reliably as long as the pressure loss of the coolant returning through the communication passage 30F and the pressure loss of the coolant returning through the communication passage 30S are equal. The coolant circulation during the coolant stopping control is thus restrained further reliably. For example, by increasing the length of one of the tubes configuring the two communication passages 30F, 30S compared to the other tube and, by a corresponding amount, increasing the inner diameter of the tube having the increased length compared to the other tube, the pressure loss of the coolant returned through the communication passage 30F and the pressure loss of the coolant returned through the communication passage 30S are equalized. Even if there is a difference between the pressure loss of the coolant returning through the communication passage 30F and the pressure loss of the coolant returning through the communication passage 30S, the coolant circulation during the coolant stopping control can be restrained as long as the difference is in such a range that the difference in internal pressure between the joint passages 19F and 19S is not increased, as has been described.

In the above-described embodiment, a centrifugal pump is employed as the water pump 16. However, even when a positive displacement pump is employed, the coolant circulation through the water jackets during the coolant stopping control can also occur if the pump has multiple discharge holes that communicate with each other in the interior of the pump. Even in this case, by arranging the communication passages each communicating with the suction hole of the water pump in the corresponding joint passages, which join the corresponding discharge holes to the water jackets, decrease of the warm-up promoting effect for the engine through the coolant circulation during the coolant stopping control is restrained.

Second Embodiment

An engine cooling apparatus according to a second embodiment will now be described with reference to FIG. 6.

In the first embodiment, the illustrated engine cooling apparatus is employed in the V engine having the coolant circuit in which coolant circulates through the two water jackets 13F, 13S, each of which is provided in the corresponding one of the banks. The engine cooling apparatus includes the communication passages 30F, 30S, which restrain the coolant circulation during the coolant stopping control. The structure related to restraint of the coolant circulation during the coolant stopping control can also be employed in an engine cooling apparatus including a coolant circuit in which coolant circulates through three or more water jackets. The structure can also be employed in an engine having cylinders arranged in any shape other than the V shape.

Figure 6:
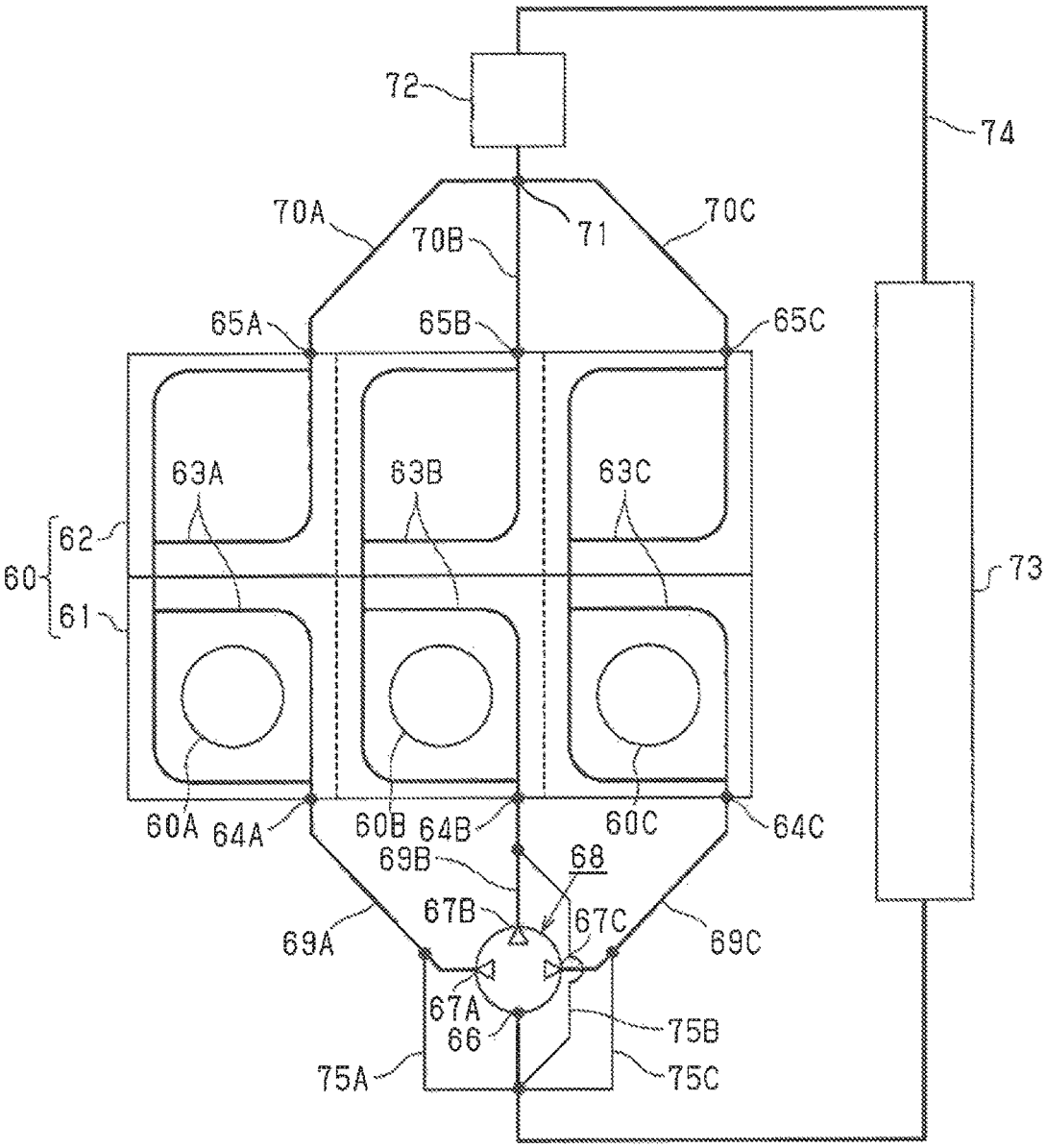
FIG. 6 is a diagram schematically illustrating the configuration of a coolant circuit included in an engine cooling apparatus according to a second embodiment.
Figure 7:
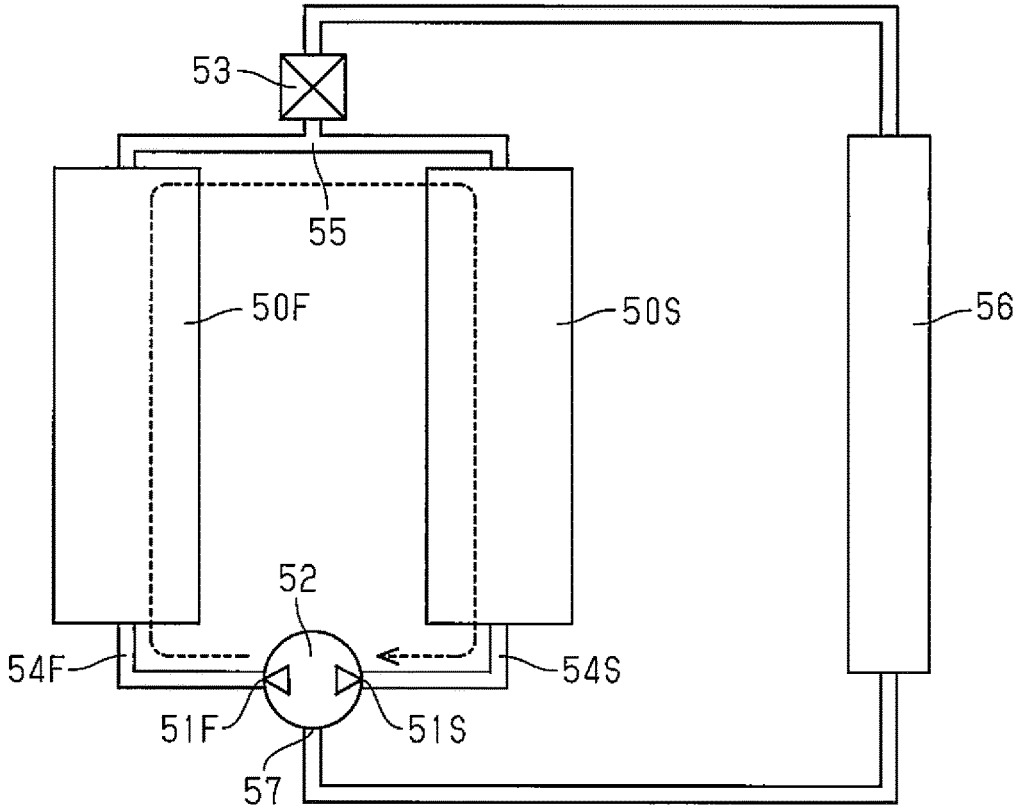
Fig.7(Prior Art)
FIG. 7 is a diagram representing a coolant flow in a conventional engine cooling apparatus during coolant stopping control.

An engine 60, which is illustrated in FIG. 6, is an inline three engine. In a cylinder block 61 and a cylinder head 62 of the engine 60, three water jackets 63A, 63B, 63C are arranged in correspondence with the cylinders. Each of the water jackets 63A, 63B, 63C is a passage in the engine 60, in which coolant flows around a corresponding one of combustion chambers 60A, 60B, 60C of the cylinders. Inflow holes 64A, 64B, 64C of the water jackets 63A, 63B, 63C for coolant are arranged in the cylinder block 61. Outflow holes 65A, 65B, 65C of the water jackets 63A, 63B, 63C for coolant are each arranged in the cylinder head 62.

An engine cooling apparatus of the present embodiment includes a coolant circuit in which coolant circulates through the three water jackets 63A, 63B, 63C. The coolant circuit has a mechanical water pump 68, which includes a suction hole 66 and three discharge holes 67A, 67B, 67C corresponding to the three water jackets 63A, 63B, 63C. The water pump 68 is driven by rotation of the engine output shaft to discharge, through each of the discharge holes 67A, 67B, 67C, the coolant that has been drawn in through the suction hole 66. Each of the discharge holes 67A, 67B, 67C of the water pump 68 is joined to the inflow hole 64A, 64B, 64C of the corresponding one of the water jackets 63A, 63B, 63C through a corresponding joint passage 69A, 69B, 69C.

Ejection passages 70A, 70B, 70C are respectively joined to the outflow hole 65A, 65B, 65C of the water jackets 63A, 63B, 63C. The downstream ends of the ejection passages 70A, 70B, 70C are merged in a merging portion 71 and then connected to a coolant stopping mechanism 72. A return passage 74, in which a radiator 73 is arranged, is connected to the coolant stopping mechanism 72. The downstream end of the return passage 74 is connected to the suction hole 66 of the water pump 68. By blocking outflow of coolant from the merging portion 71 into the return passage 74, which is return flow of coolant from the merging portion 71 to the suction hole 66, the coolant stopping mechanism 72 stops the coolant circulation through the water jackets 63A, 63B, 63C. In this coolant circuit, the return passage 74 is the passage connected to the suction hole 66.

In the coolant circuit, the downstream sides of the water jackets 63A, 63B, 63C communicate with one another in the merging portion 71, which is located upstream of the coolant stopping mechanism 72. This forms a path in which coolant is allowed to flow through the water jackets 63A, 63B, 63C among the discharge holes 67A, 67B, 67C of the water pump 68 during the coolant stopping control. Therefore, the coolant circuit also has such a structure that the above-described coolant circulation during the coolant stopping control can occur.

In the engine cooling apparatus of the present embodiment, the coolant circuit has communication passages 75A, 75B, 75C, each of which ensures communication between the corresponding one of the three joint passages 69A, 69B, 69C and the suction hole 66 of the water pump 68. The end of each communication passage 75A, 75B, 75C on the side corresponding to the suction hole 66 is connected to a section of the return passage 74 downstream of the radiator 73. The communication passages 75A, 75B, 75C function in the same manner as the communication passages 30F, 30S arranged in the engine cooling apparatus of the first embodiment. This restrains coolant circulation during the coolant stopping control, thus restraining decrease of the warm-up promoting effect for the engine, which would otherwise be caused by the coolant circulation.

Although the multiple embodiments have been described herein, it will be clear to those skilled in the art that the present disclosure may be embodied in different specific forms without departing from the spirit of the disclosure. The disclosure is not to be limited to the details given herein, but may be modified within the scope and equivalence of the appended claims.

The invention claimed is:

1. An engine cooling apparatus comprising:

a mechanical water pump configured to be driven by rotation of an output shaft of an engine, the water pump having a suction hole through which coolant is drawn and N discharge holes through which the coolant is discharged;

N water jackets arranged in the engine to extend around a combustion chamber of the engine, the water jackets each corresponding to one of the N discharge holes;

N joint passages each of which joins one of the N discharge holes to the associated water jacket;

a merging portion in which the coolant merges after passing through the N water jackets;

a return passage that returns the coolant that has merged in the merging portion to the suction hole;

a coolant stopping mechanism configured to block return flow of the coolant through the return passage; and N communication passages each of which allows one of the N joint passages to directly communicate with the suction hole while bypassing the N water jackets and the coolant stopping mechanism, wherein N is an integer not less than two.

2. The engine cooling apparatus according to claim 1, wherein the N communication passages are merged in a suction-side passage connected to the suction hole, the suction-side passage has N draw-in holes to each of which one of N communication passages is connected, and each of the N draw-in holes is arranged to be offset from the other draw-in holes.

3. The engine cooling apparatus according to claim 1, wherein the N communication passages are configured such that pressure losses of the coolant are the same in all of the N communication passages when the coolant returns from the joint passages to the suction hole through the communication passages.

4. The engine cooling apparatus according to claim 1, wherein tubes configuring the N communication passages have equal lengths and equal inner diameters.

5. The engine cooling apparatus according to claim 1, wherein the N communication passages are configured such that the pressure loss of the coolant when the coolant returns from the joint passages to the suction hole through the communication passages is greater than the pressure loss of the coolant when the coolant returns from the joint passages to the suction hole through the water jackets and the return passage.

6. The engine cooling apparatus according to claim 1, wherein the water pump, the N joint passages, and an in-cover passage connected to the suction hole are arranged in a chain cover, and the N communication passages are each configured by a hose that connects one of the N joint passages to the in-cover passage.

7. The engine cooling apparatus according to claim 1, wherein the engine cooling apparatus is employed in a V engine having two banks, and the N water jackets are two water jackets each arranged in one of the two banks.

* * * * *